US005353937A

United States Patent [19]

Childress

[11] Patent Number: 5,353,937

[45] Date of Patent: Oct. 11, 1994

[54] AUTOMATIC VARIABLE EJECTOR DELAY TIME AND DWELL TYPE MECHANISM IN A SORTING APPARATUS

[75] Inventor: Joel P. Childress, Sugarland, Tex.

[73] Assignee: ESM International, Inc., Houston, Tex.

[21] Appl. No.: 62,949

[22] Filed: May 17, 1993

[51] Int. Cl.[5] ..... B07C 5/00

[52] U.S. Cl. ..... 209/563; 209/581; 209/587

[58] Field of Search ..... 209/559, 563–566, 209/581, 587, 911

[56] References Cited

U.S. PATENT DOCUMENTS

| | | | |
|---|---|---|---|
| 3,669,263 | 6/1972 | Babb | 209/564 |
| 4,096,949 | 6/1978 | Hoover et al. | 209/564 |
| 4,134,498 | 1/1979 | Jones et al. | 209/564 |
| 4,207,985 | 6/1980 | Lockett et al. | 209/564 |
| 4,235,342 | 11/1980 | Braham | 209/564 |
| 4,271,968 | 6/1981 | Mehrkam et al. | 209/564 |
| 4,344,539 | 8/1982 | Lockett | 209/564 |
| 4,369,886 | 1/1983 | Lane et al. | 209/564 |
| 4,981,580 | 1/1991 | Auer | 209/564 X |

FOREIGN PATENT DOCUMENTS

| | | | |
|---|---|---|---|
| 1267774 | 3/1972 | United Kingdom | 209/564 |
| 8803063 | 5/1988 | World Int. Prop. O. | 209/564 |

*Primary Examiner*—D. Glenn Dayoan
*Attorney, Agent, or Firm*—Vaden, Eickenroht, Thompson, Boulware & Feather

[57] ABSTRACT

A method and apparatus are disclosed for detecting and ejecting articles of different weights in a product and article stream, by varying the dwell and delay time in accordance with the color classification of the products and articles being sorted. The ejector dwell and delay times are determined by the weight of the products and articles, which can be identified by the percentage reflectivity of color wavelengths of interest.

37 Claims, 8 Drawing Sheets

AUTOMATIC VARIABLE EJECTOR DELAY TIME AND DWELL TYPE MECHANISM IN A SORTING APPARATUS

BACKGROUND OF THE INVENTION

1. Field of the Invention

This invention pertains to sorting machines that optically sort or separate acceptable homogeneous products from unacceptable homogeneous products and other, non-homogeneous articles as the products and articles flow past a viewing window of such a machine on the basis of color classifications and weights.

2. Description of the Prior Art

A typical sorting machine of the type with which the present invention is used is a high speed sorting machine typically used for sorting homogeneous products in the food industry or otherwise. For example, individual coffee beans are caused to flow by gravity feed down a steep channel or chute to be sorted by such a machine to separate "unacceptable" beans from "acceptable" ones. The term "unacceptable" applies to beans that are outside of a predetermined acceptable range of "color" hue in one or more wavelength bands of light, which bands are in some cases outside of the visible color spectrum. In the simplest case, the items are sorted for variation from a hue or shade of color, including a shade of black or white and thus a shade of gray, in a single spectrum. Such a sorting procedure is referred to as monochromatic sorting since only a single radiation spectrum is being observed. In a more complex optical color sorting operation, the flow of items is sorted to determine when an item is reflecting an unacceptable radiation amount in either of two wavelength bands. Such a sorting procedure is referred to as bichromatic sorting. It will be apparent that more than two radiation bands can be employed, if desired.

Optical sorting machines of the type generally described above employ optical sensors that include one or more photodetectors, such as photodiodes. The photodetectors are positioned to observe the illuminated product stream through a light admitting viewing window. The stream of product passes between an optical sensor and a background having a color or shade that matches the product stream in standard color or shade, so that only a variation in a product color or shade causes a detection event. The illumination is from one or more lamps directed at the product stream to cause standard reflectivity from acceptable products in the one or more wavelength bands being observed and to cause unacceptable reflectivity from unacceptable products and articles in those bands.

The machines also include an ejector mechanism located downstream from the sensor or sensors and actuated by an electrical signal originating from sensor detection. When a unacceptable product or article is detected, an electrical signal is produced and the ejector is actuated just as the unacceptable product or article and the mechanism are in alignment. Therefore, there is a very slight delay time from the time of sensing to the time of ejecting, which varies depending on the weight of the product. The typical ejector mechanism is usually an air ejector that has a variable "dwell time." The dwell time of an ejector is the length of time the ejector is fired, which varies depending on the weight of the product.

As mentioned above, the product stream flows in front of a background having a color or shade that is critical to the overall operation in that it must match the product under detection in the wavelength band or bands being observed by the sensors. U.S. Pat. No. 4,235,342 ("'342 patent"), commonly assigned to the assignee of the present invention, provides a description of a mechanism for correcting any color variation in the background due to common problems such as dust accumulation and/or background fading or clouding. The '342 patent is hereinafter incorporated by reference for all purposes.

As the '342 patent shows, the apparatus accurately utilizes a programmable classifier to classify the product in accordance with the percentage reflectivity of two predetermined color wavelengths. The programmable classifier includes an electrical signal generator adapted to generate first and second electrical signals respectively representative of the intensity of light energy reflected from the product being sorted at respective first and second color wavelengths and a programmable memory element having a matrix array of storage locations therein. Each point in the array is addressable by a combination of electrical signals corresponding to the reflected light intensities at the first and second color wavelengths from a product being sorted. At least one profile containing addresses corresponding to reflectivities of an acceptable product is used to program the memory with an electrical signal representation of the acceptability of a product having reflectivities defining the addressed location.

The system is ready to sort product as soon as the memory is programmed. When an individual unacceptable product passes in front of the viewing window, an ejector control arrangement exposes substantially the same portion of each unacceptable product to be ejected with the pressurized jet. The delay time from detection of the product in the viewing window to when the product is opposite the ejector is preset and based on the weight of the products being sorted. The time of the exposure of the ejecting force to the product, i.e., the dwell time, is also preset and based on the weight of the product. Once the delay and dwell times are pre-selected and set, they do not vary during a product sorting session.

Typically, dwell times are adjusted to be longer than necessary to assure ejection of unacceptable product, even though, shorter dwell times might seem desirable, because accidental ejection of acceptable product located near the unacceptable products may occur if the dwell time is to long. In the sorting industry, however, it is more important to eject some acceptable product than to miss unacceptable product.

The apparatus described in the '342 patent is very effective in removing unacceptable product from a stream of only homogeneous product, wherein some of the product are defective and, thus, unacceptable. However, in common practice, the stream of product includes not only homogeneous, but non-homogenous articles, such as white rocks, black rocks, and other foreign material, such as sticks or nubs (small, shriveled peanuts). In some instance, these non-homogeneous articles are identified as unacceptable as they pass in front of the viewing window, but are not removed from the product stream by the ejector because the non-homogeneous articles travel faster than homogeneous products, or are so heavy that the ejector force required to remove them would remove too much acceptable product if the system were set-up to accommodate removal of heavy non-homogeneous articles.

Likewise, there are occasion when light non-homogeneous articles tend to slide through the viewing element more slowly than the homogeneous products and thus, would not be positioned at such appropriate time in front of the ejector for removal of such article from the product stream.

It is therefore a feature of the present invention to provide a sorting machine capable of automatically removing unacceptable homogeneous product as well as unacceptable non-homogeneous articles from a product stream.

It is another feature of the present invention to provide an improved method and a sorting apparatus and for automatically removing both unacceptable light weight and unacceptable heavy weight articles from the product stream.

SUMMARY

These and other features are accomplished, in accordance with the illustrated embodiments of this invention by a sorting machine for sorting unacceptable articles from a stream of "products" (generally, the homogeneous products being sorted), and other "articles" (generally everything else, but the products) passing through the sorting machine by gravity feed. The sorting machine includes an optical viewing station having means for reflecting light in first and second color wavelengths off the products and articles passing through the viewing station, and light receiving means adapted to generate first and second electrical signals respectively representative of the intensity of light reflected in the first and second color wavelengths from the products and articles passing through the viewing station. An article classifier responsive to the signals from the light receiving means classifies the products and articles into respective classifications on the basis of the intensity of light reflected from the products and articles at the first second wavelengths. An ejector for ejecting unacceptable articles from the stream of products and articles is responsive to a generated dwell ejector signal and a generated delay ejector signal respectively associated with a predetermined dwell time and a predetermined delay time for activating the ejector when an unacceptable article from the stream of products and articles is aligned opposite said ejector. An article is deemed unacceptable by comparing the classification thereof to a predetermined acceptable classification map and determining that the classification of the unacceptable article is in a predetermined zone outside of the predetermined acceptable classification map, wherein each predetermined zone is associated with the predetermined dwell time and the predetermined delay time.

Preferably, a single ejector responsive to variable dwell and delay ejector signals is employed. Alternately, at least two ejector are positioned a different time delay away from the optical viewing station. Each is responsive to an appropriate variable dwell ejector signal.

Objects of certain weight are classified by the intensity of light because objects of a similar color classification typically weigh the same. Thus, the dwell time and delay time selected is based on the weight of the article to thereby assure the proper ejection of an unacceptable article independently of having to actually determine the weight of the article.

BRIEF DESCRIPTION OF THE DRAWINGS

So that the manner in which the above-recited features, advantages and objects of the invention, as well as others which will become apparent, are attained and can be understood in detail, more particular description of the invention briefly summarized above may be had by reference to the exemplary preferred embodiments thereof which are illustrated in the drawings, which form a part of this specification. It is to be noted, however, that the embodiments of the invention are illustrative of the invention and are not to be considered limiting of its scope as the invention may admit to other equally effective embodiments.

In the drawings

DESCRIPTION OF THE PREFERRED EMBODIMENTS

Figure 1:
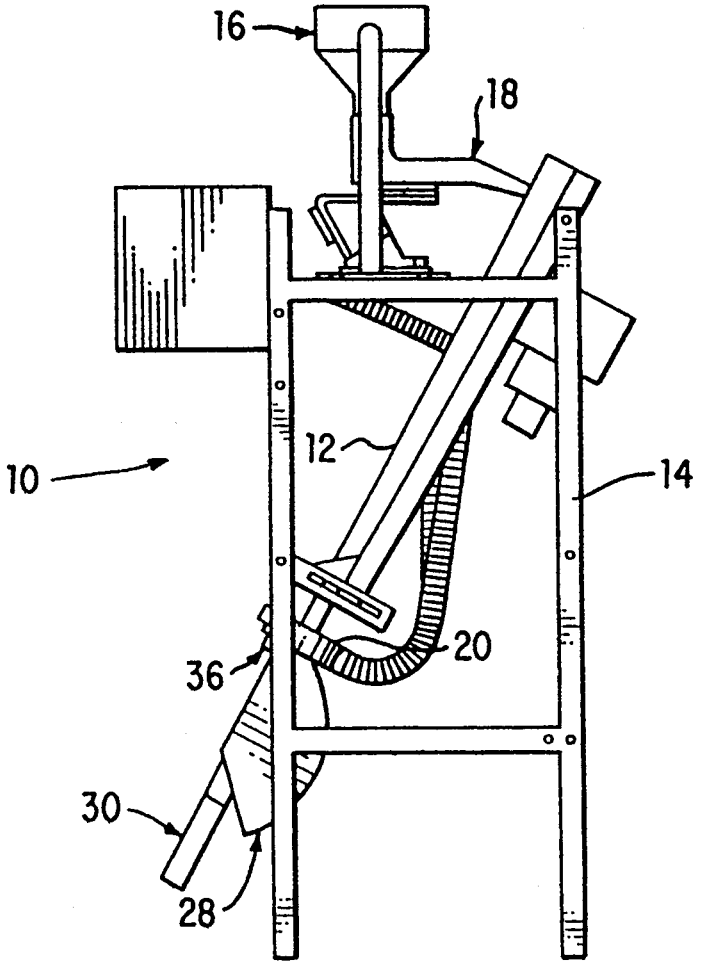
FIG. 1 is a side view of a typical electro-optical sorting machine.

Now referring to the drawings, and first to FIG. 1, a high speed sorter is shown for separating unacceptable homogeneous products or items and other articles from a passing stream or flow of such products and articles. Generally, machine 10 includes one or more channels or chutes or slides 12 at steep angle, usually over 45° and preferably nearly vertical on the order of 80°. The channels are held in position by a framework 14 and gravity feed the products and articles to be sorted at the top by a hopper 16 attached to the same framework. The products and articles feed from hopper 16 through dividing vibratory feeder 18 to channels 12. Although a commercial machine usually has two or more channels 12 operating simultaneously with respect to the products and articles that flow, machine 10 is discussed hereinafter as including only a single channel 12.

The products to be separated or sorted by machine 10 are small fungible homogeneous items, such as coffee beans. Coffee beans, it will be appreciated, are individually identifiable by color in one or more spectral bands.

The feed from the hopper via the vibratory feeder and down channel is all by gravity action. The flow of the article is only slowed from free fall by the friction caused by the beans and the surfaces of the path. The products do move, however, at a fast rate and in large quantity, as is well known in the art.

An optical viewer or sensor 20, described more fully below, is located toward the bottom part of the channel. Although referred here in the singular, as is later explained, the "sensor" is usually more than one sensor in an actual machine. As the flow of products passes past the sensor, any unacceptable products and unacceptable articles are sensed or detected. It will be appreciated that such sensing or detection requires the unacceptable products and articles to be distinguished both from the standard products and the background. Typically, an unacceptable product or article is detectable on the basis of its being darker or lighter or of a different color or hue from an acceptable range of darkness, lightness or color predetermined for standard acceptable products. This sensing can be in a single spectral range for monochromatic detection, in two separated spectral ranges for bichromatic detection, or in a plurality of spectral ranges for multichromatic detection. It is understood that a "spectral range" can be wholly or partially in the visual spectrum or can be wholly or partially in the nonvisual spectrum. For example, sensing in the infrared range is commonly done. When an unacceptable product or article is sensed, an electrical signal is produced that results in an ejection of the unacceptable product or article by the actuation of an ejector mechanism.

An ejector 36 located underneath and adjacent optical sensor means 20 is actuated by the actuation electrical signal just mentioned to produce an air blast to remove an unwanted unacceptable product or article from the flow of products and articles in the product stream. The ejector can be a mechanical ejector, if desired. When the actuation signal occurs, typically, a solenoid valve is operated to release or emit an air blast at the product stream to timely remove the unacceptable product or article. The delay in actuation is typically very short following the time of sensing, the timing being such as to produce the desired expelling of the detected unacceptable product or article. The timing is appropriate to the weight of the item expelled, be they products or articles. The unacceptable items thus removed in the process fall down into reject accumulator 28 for subsequent disposal. The products not removed continue down channel extension 30 to be gathered or packaged as quality products passing the preset standards and avoiding removal. The control of the flow and the sensitivity of the sensors are controlled by preset controls that are well-known in the art.

Figure 2:
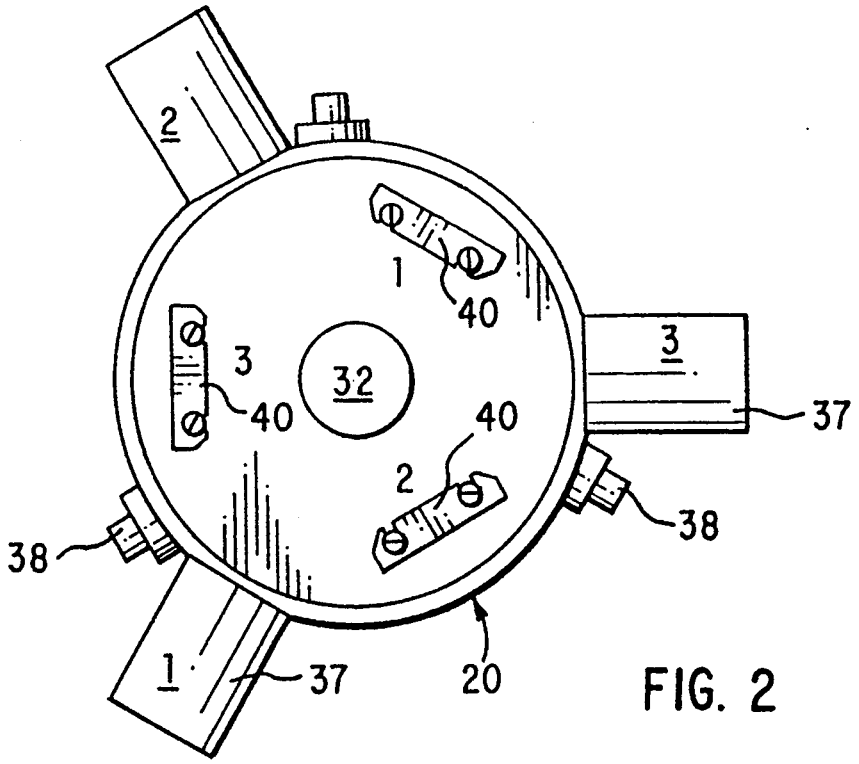
FIG. 2 is a top view of an optical viewing station of an electro-optical sorting machine, such as shown in FIG. 1.

Now referring to FIG. 2, the viewing or optical sensor and related components of the machine are illustrated as seen from above. Sensor means 20 generally is a ring-like structure with a center opening 32, the flow of the products and articles to be separated or sorted as discussed above passing through the opening at a "window" location or plane. This is the electro-optical viewing station for the machine. The optical or viewing mechanism is well-known and generally includes three evenly, peripherally spaced individual sensors 37, each of which typically includes a photocell or photodiode. At least three lamps 38 are included in the plane, one for each of the three individual sensors. Each lamp 38 projects a beam against a separate background plate 40, the reflection therefrom and from any products flowing between the background plate and a photocell sensor being detected by the sensor. The reason that three sensors are employed is to ensure sensing an unacceptable item that is detectable from only one direction and not necessarily from another direction. Only one lamp 38 is shown for each viewing combination of photocell sensor 37 and background plate 40. In actual practice, there are usually multiple lamps 38 for illuminating the product stream uniformly and the same or additional multiple lamps for illuminating the background plate uniformly.

Figure 3:
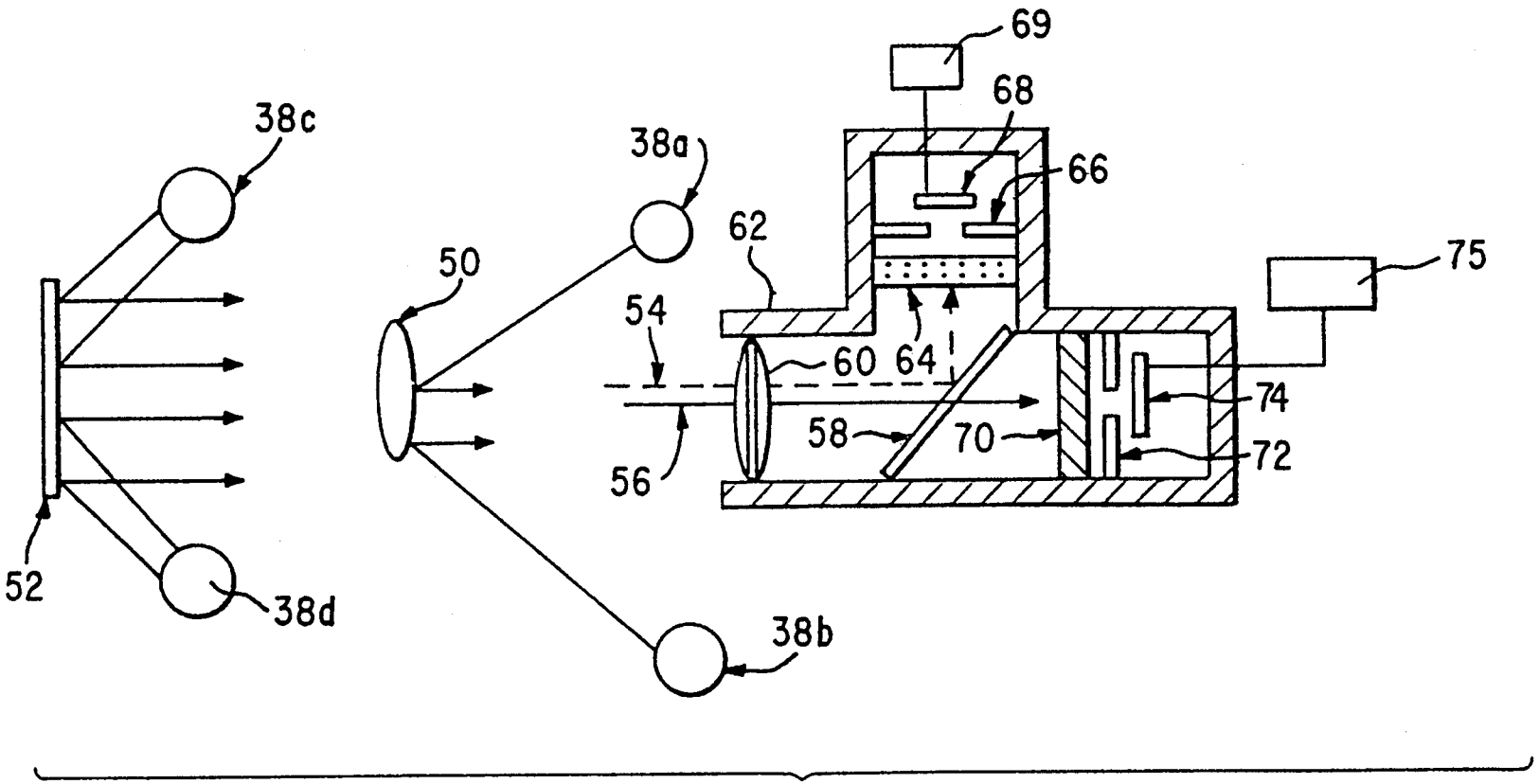
FIG. 3 PRIOR ART
FIG. 3 is a diagrammatic illustration of a bichromatic optical viewing station of a sorting machine in accordance with the prior art.

A typical prior art bichromatic sensing arrangement where the product stream is viewed in two spectral bands or ranges is shown in FIG. 3. Item 50 in the product stream is illuminated by product lamps 38*a* and 38*b* and painted background 52 is illuminated by background lamps 38*c* and 38*d*. The reflected light spectrum includes longer wavelengths of light 54 in a first spectral range and shorter wavelengths of light 56 in a second spectral range. The first and second spectral ranges are preselected or predetermined as being significant for the product being sorted. If the product reflects less than a predetermined amount of light in either spectral range, then the item is unacceptable and will be rejected, as discussed previously.

Beamsplitter 58 is established at 45° with respect to the paths of reflected light 54 and 56 as focused by lens 60 located across the entrance of sensor housing 62. The longer wavelengths are reflected by the beamsplitter and are filtered by long wavelength narrow band filter 64. Longer wavelengths of light do not pass through the beamsplitter and short wavelengths are not reflected by the beamsplitter. Optical stop 66 located behind filter 64 includes a small opening for viewing by photocell 68 tuned to detect long wavelengths in the narrow spectral band permitted by filter 64. Photocell 68 is connected to a detector 69 that generally includes a comparator for determining if the predetermined minimum standard level of reflected light is present in the predetermined longer wavelength spectral range with respect to a standard level furnished by accompanying hardware and/or software.

In a similar fashion, the shorter wave wavelengths are passed through the beamsplitter and are filtered by short wavelength narrow band filter 70. Short wavelengths of light do not reflect from the beamsplitter and long wavelengths of light do not pass through the beamsplitter. Optical stop 72 located behind filter 70 includes a small opening for viewing by photocell 74 tuned to detect short wavelengths in the narrow spectral band permitted by filter 70. Photocell 74 is connected to a detector 75 that generally includes a comparator for determining if the predetermined minimum standard level of reflected light is present in the predetermined shorter wavelength spectral range with respect to a standard level furnished by accompanying hardware and/or software.

A monochromatic machine would not include a beamsplitter but would include a filter or filters for assuring that the product reflections in the spectral range of interest are focused on the photocell for detection purposes.

In a typical prior art sorting machine, the output signals from the comparators included in detectors 69 and 75, either alone or in combination, are used to activate an ejector driver at a constant delay time away from the time the detector detects a item. The ejector fires for a constant dwell time to eject an unacceptable item. However, since unacceptable items include unacceptable homogeneous products and non-homogeneous articles, which very in weight and composition, the unacceptable non-homogeneous articles may be missed if there is no compensation for the differences that exist between a product and an article because the constant dwell and delay times are set for ejecting unacceptable homogeneous products, which may be ineffective in removing a non-homogeneous article.

Figure 4:
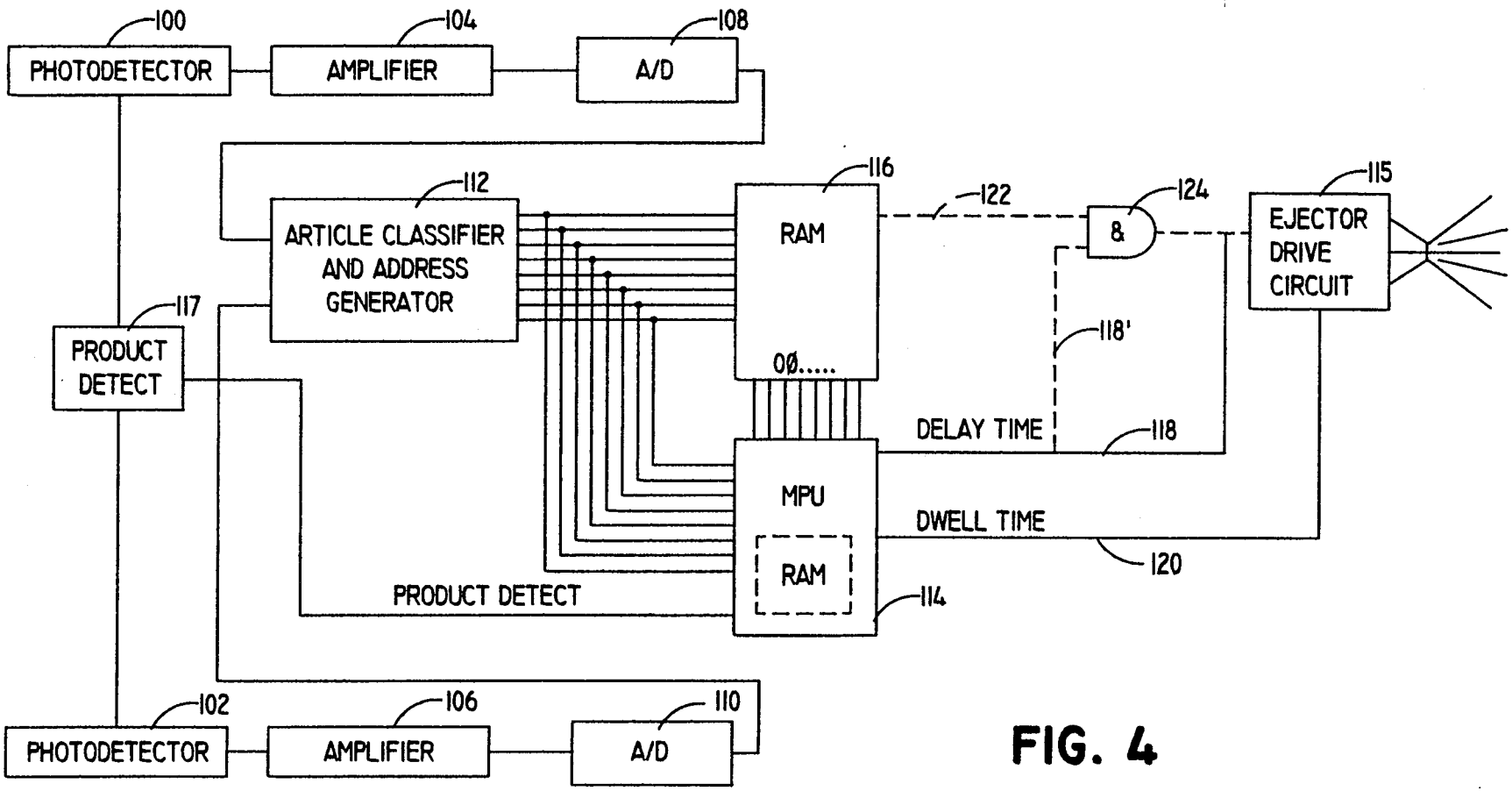
FIG. 4 is a schematic representation of the variable ejector dwell time and delay time circuitry in accordance with a preferred embodiment of this invention.

In a preferred embodiment of this invention, a system such as that as shown FIG. 4, is used to classify a sensed product or article being sorting by the percentage of reflectivity of two predetermined wavelengths and to adjust the ejector dwell and delay times in accordance with the classification of such product or article being sorted. Photodetectors 100 and 102 can be configured in a system such as that shown in FIG. 3 in the place of photocells 68 and 74 by one of ordinary skill in the art. The signals generated by photodetectors 100 and 102 are subsequently respectively amplified by amplifiers 104 and 106 and converted to digital signals by analog-to-digital (A/D) converters 108 and 110, respectively. The two digital output signals from A/D converters 108 and 110 are combined in article classifier 112 to classify the article being sorted in accordance with the percentage reflectivity of the two wavelengths detected by photodetectors 100 and 102. Article classifier can be any classification circuitry well known to one skilled in the art, such as that described in '342 patent.

Microprocessing unit ("MPU") 114 monitors the classification signal produced by article classifier 112 to identify the existence of an unacceptable item and to determine the appropriate dwell and delay times associated with such unacceptable item based on the percentage reflectivity of the two wavelengths detected at photodetectors 100 and 102. In a preferred embodiment of this invention, the accept/reject and delay and dwell time information is stored in memory 116, in a product property look-up table. An accept/reject signal and the appropriate dwell and delay time indicators are determined for each product and article. MPU 114 than activates ejector drive circuitry 115 at the appropriate delay time away from detection of a product detect signal from product detect circuitry 117 along line 118 for a specified dwell time as indicated on line 120. The components in FIG. 4 can easily be selected and configured by one of ordinary skill in the art.

Figure 5:
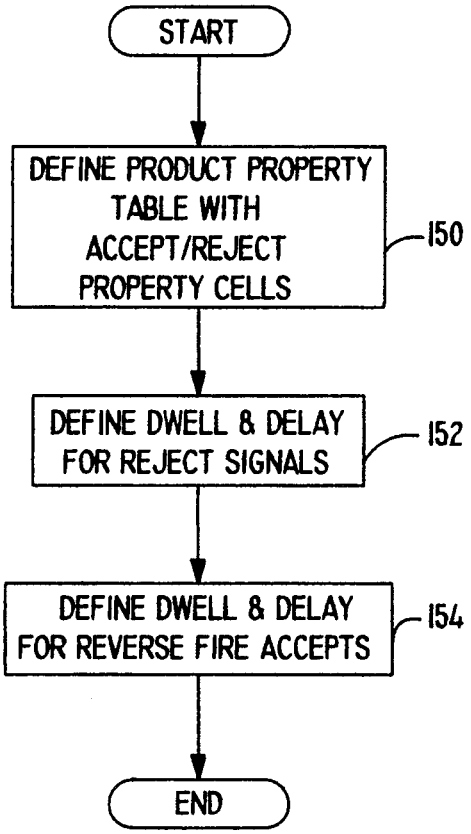
FIG. 5 is a flow diagram of the software for setting up a product property look-up table in accordance with a preferred embodiment of this invention.

Prior to sorting products utilizing the system shown in FIG. 4, a product property look-up table is defined. FIG. 5 shows a flowchart of the software used to define the product property look-up table to be used in conjunction with MPU 114. In the preferred embodiment of this invention, article classifier 112 generates an address which is representative of the percentage reflectivity of the two wavelengths being monitored. The generated classification address is used as a pointer to access information in the product property look-up table stored in memory 116. An accept or reject signal is stored at each classification address, Step 150. The appropriate dwell and delay times are also stored at the classification address, Step 150.

In the event that the operator of the sorting machine wishes to eject acceptable product, the machine can be put into a reverse fire mode. Thus, the appropriate dwell and delay times associated with the acceptable product are also sorted in memory 116, at the appropriate classification address Step 154. The process of inputting all these values into memory can be done manually or by sorting samples of products and articles of known color classifications and subsequently setting the values in the product property look-up table.

Once the product property look-up table is established, software prepared in accordance with the flowchart in FIG. 5 is utilized to sort or separate products and articles. First, the product property look-up table is loaded into memory, Step 160. The machine then waits until an item is detected in the optical viewer, Step 160. As soon as the item is detected, the article classification signal is identified, Step 164, and mapped into the product property look-up table, Step 166. Then, the MPU determines whether the item is acceptable, Step 168. If the item is unacceptable, then the MPU determines whether or not the machine is in reverse fire mode, Step 170. If the item is to be ejected then the MPU accesses the dwell and delay time from the property look-up table, Step 172, sets the dwell and delay time for the ejector driver, Step 174, and ejects the item, Step 176. A similar sequences of events occurs if the item is acceptable and in reverse fire mode, Step 178. Finally, the MPU determines whether more items are to be sorted, Step 180.

In the embodiment of this invention described above, each time a product or article is classified by article classifier 112, MPU 114 must make a memory access to memory 116 to determine whether the article should be ejected. If the product or article is to be ejected, then the memory must be accessed again to determine the appropriate dwell and delay times associated with that product or article being ejected.

Figure 7:
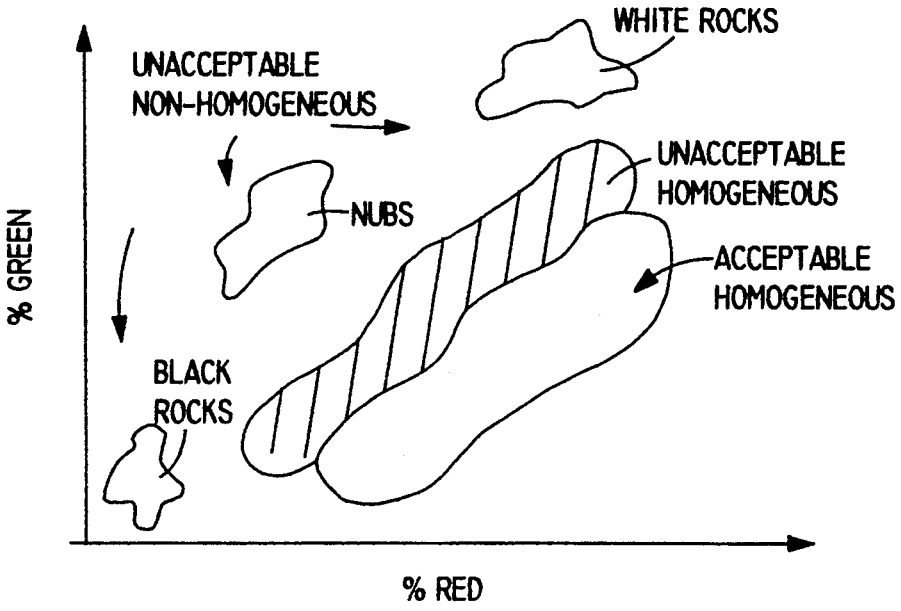
FIG. 7 is a graphical representation of the location of product and articles relative to the percentage of red and green formed in accordance with an alternate preferred embodiment of this invention.
Figure 6:
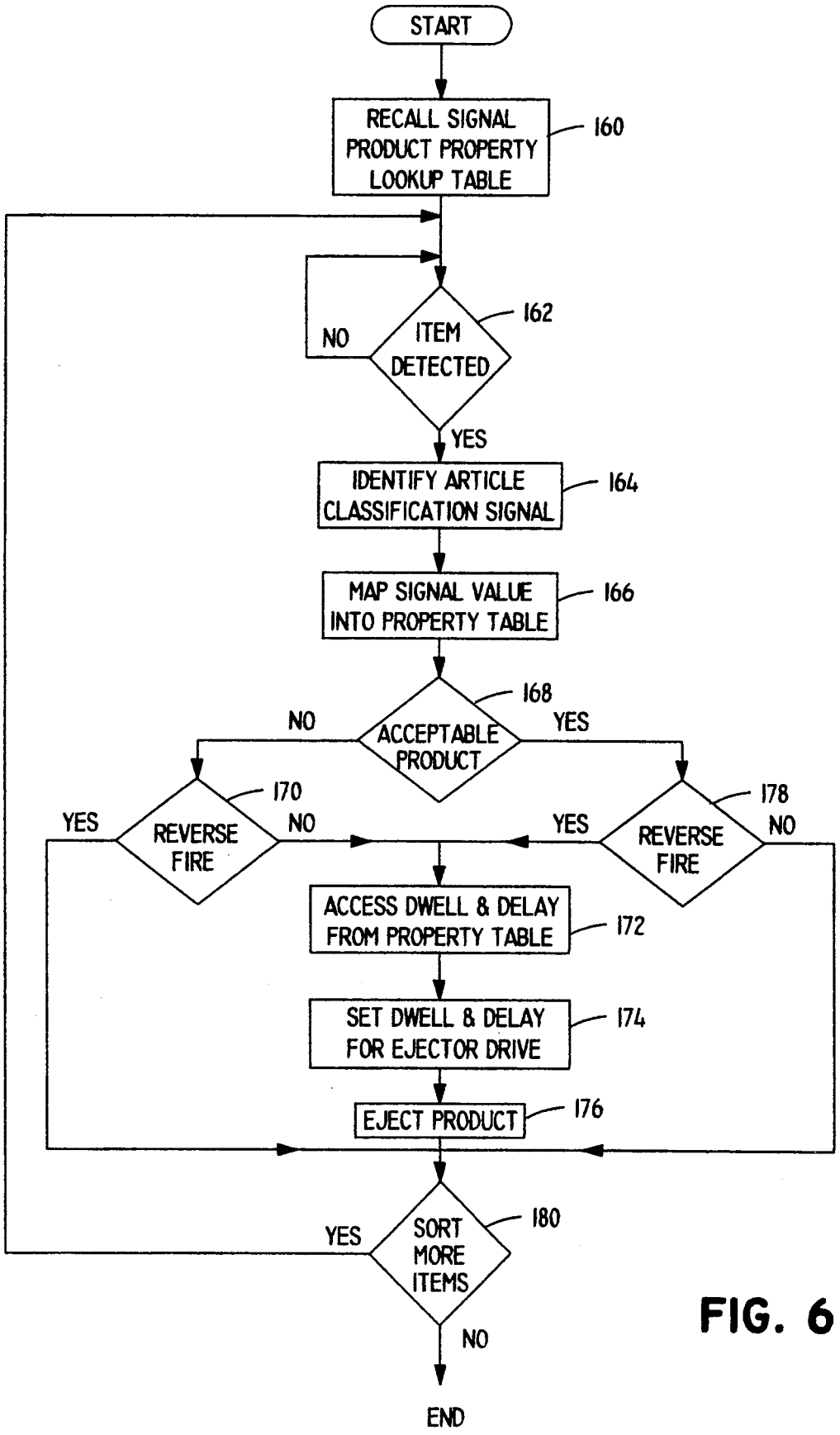
FIG. 6 is a flow diagram of the software used to sort product in accordance with a preferred embodiment of this invention.

In an alternate preferred embodiment of this invention, software is used to take advantage of the assumption that articles of a certain weight tend to be in an identifiable color range and, thus, in an identifiable classification address range. The graph in FIG. 7 illustrates this concept. The abscissa represents the percentage of red wavelength light reflected from a product being sorted and the ordinate represents the percentage of green wavelength light reflected from the product being sorted. The red and green wavelengths are examples of wavelengths that are monitored. However, any color wavelengths can be used.

For discussion purposes, assume coffee beans are the products being sorted. All coffee beans are considered homogeneous products. In a batch of coffee beans to be sorted, typically there are both unacceptable and acceptable products. All products having a percentage red reflectively and a percentage green reflectivity identified by the area on the graph marked as "acceptable homogeneous" products are acceptable. Anything that is not an acceptable homogeneous product is to be ejected. The majority of unacceptable items are products having the percentage reflectivity of red and green located in the area marked "unacceptable homogeneous" products and such items are to be ejected. Typically, prior to sorting products, the products are filtered to remove extraneous non-homogeneous articles such as white rocks, nubs, and black rocks, but many times the non-homogeneous products get through the filtering process.

It has been determined that non-homogeneous articles can also be identified by their percentage reflectivities of red and green wavelength light as indicated by the areas on the graph marked "white rocks," "nubs," and "black rocks." These non-homogeneous articles not only vary in color from one another and from the unacceptable homogeneous products, they also vary in weight and, thus, require different dwell and delay times to assure the proper ejection of these unacceptable articles.

Figure 8:
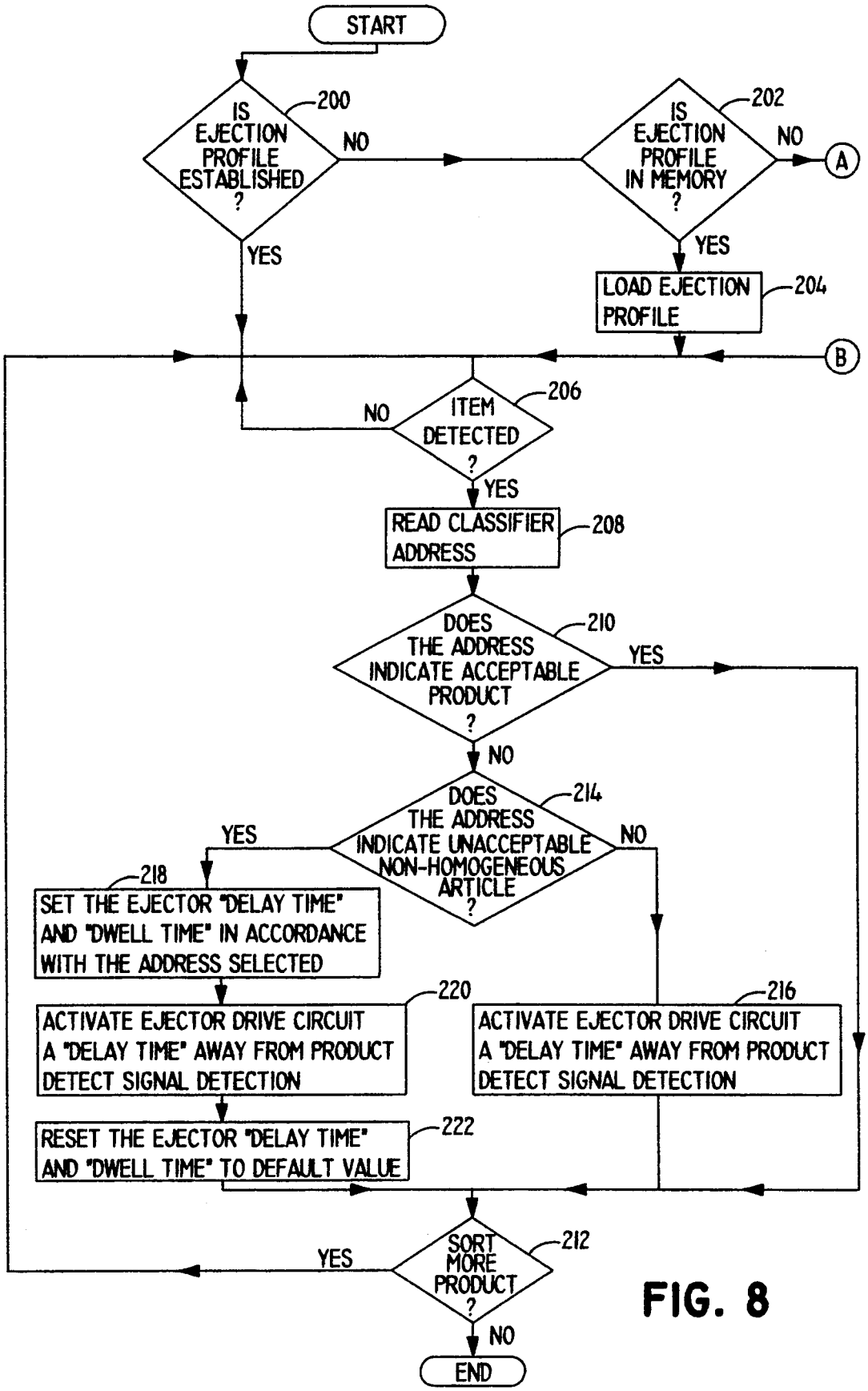
FIG. 8 is a flow diagram of the variable ejector dwell time and time delay software used in accordance with the alternate preferred embodiment of this invention.

FIG. 8 shows the flowchart for software that can be used in conjunction with the system shown in FIG. 4 to perform the sorting operation. When the article classifier generates an address representative of the article classification to access memory 116, an ejection signal is generated on line 122 if the product is to be ejected. MPU 14 produces an eject signal on line 118', at a dwell time away from the detection of the product detect signal, and simultaneously produces a signal representative of the appropriate dwell time on line 120.

Referring back to FIG. 8, operation begins with the inquiry to determine if an ejection profile has been established, Step 200. The ejection profile includes the address ranges of acceptable homogeneous products, unacceptable homogeneous products, and unacceptable non-homogeneous articles. The appropriate accept and reject signals are stored at the corresponding address in memory 116. Default dwell and delay times are established for ejecting anything except the identifiable unacceptable non-homogeneous articles and acceptable homogeneous products. Different dwell and delay times are assigned to unacceptable non-homogeneous articles where the weights and compositions of the articles are different from the unacceptable homogeneous product.

If the ejection profile is in memory, then the profile is loaded into random access memory 116 and the on-board random access memory in MPU 114, Steps 202 and 204. The software then waits until an item is detected at the viewing optical station, Step 206, at which time the classifier address is read by MPU 114, Step 208. As mentioned earlier, the classification address is used to access the corresponding address space in memory 116, which provides an output signal on line 122 when the item is to be rejected. In Step 210, the MPU determines when the classification address indicates that the item is an acceptable homogeneous product. If an acceptable homogenous product is detected, the system looks to see if there are more items is to be sorted, Step 212. If so, then the system waits for the next item to be sorted. If the detected item is not an acceptable homogeneous product, then the system determines if the item is an unacceptable non-homogeneous article, Step 214. If the item is not an unacceptable non-homogenous article, then the item is an unacceptable homogeneous product that requires the default delay and dwell times for proper ejection. Thus, MPU 116 activates the ejector drive circuit 115 through AND gate 124 using the default delay and dwell times, Step 216.

If the product is an unacceptable non-homogenous article, then the MPU sets the appropriate delay time and dwell time in accordance with the address selected, Step 218, activates the ejector drive circuit a delayed time away from product detect signal detection to eject the article, Step 220, and resets the ejector delay and dwell time to the default values, Step 222. The software continues to execute the steps mentioned above until all items have been sorted.

Figure 9:
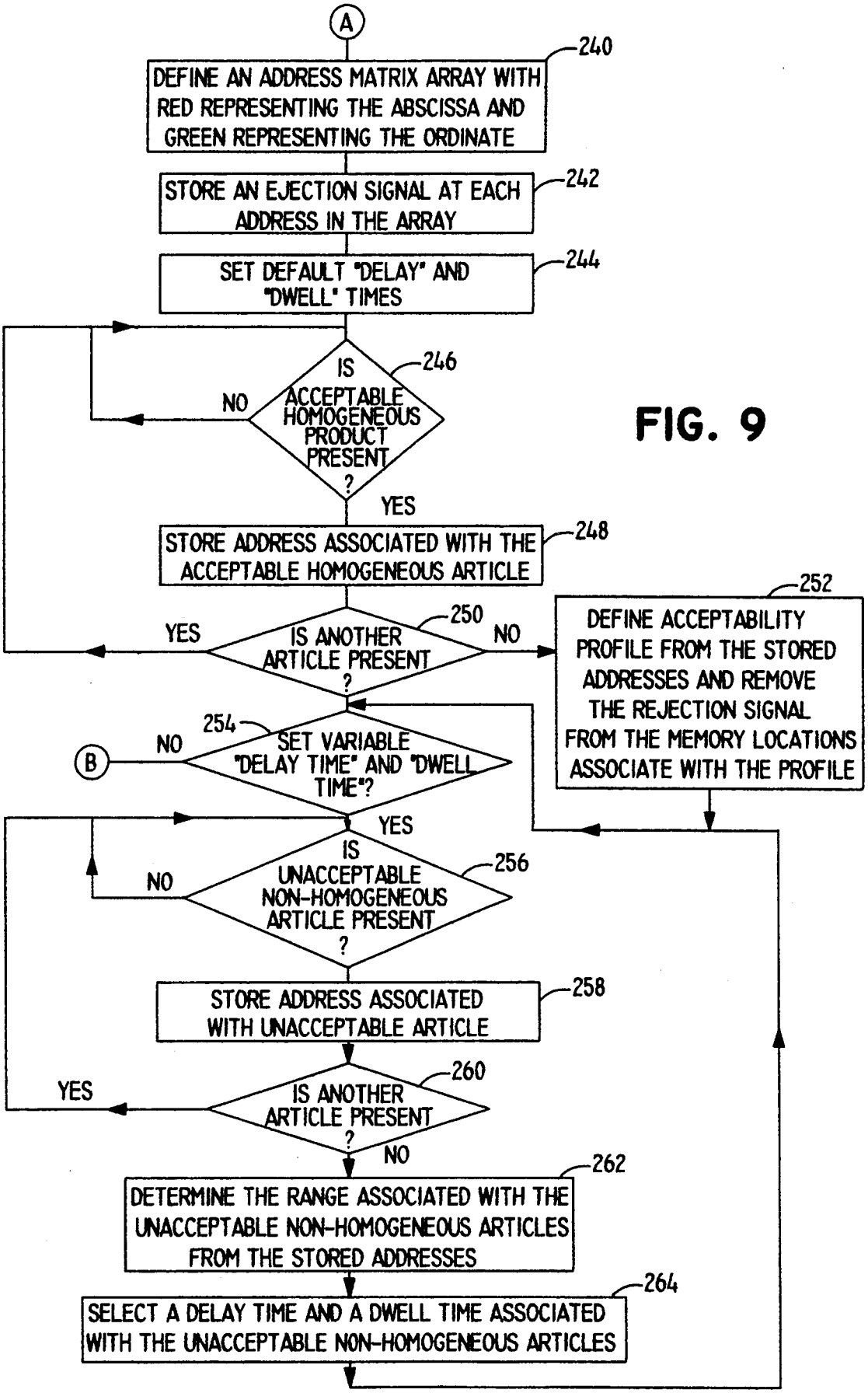
FIG. 9 is a flow diagram of the acceptability profile determining software used in an alternate preferred embodiment of this invention.

If the ejection profile is not established in memory, the operator can establish a profile by sending products and articles having identifiable color classification through the sorting machine and assigning the appropriate dwell and delay times to the various unacceptable non-homogenous articles. The software used to develop the ejection profile is shown in FIG. 9. First, an address matrix array is defined with red representing the abscissa and green representing the ordinate, Step 240. An ejection signal is stored at each address in the array, Step 242. Default delay and dwell times are then set, Step 244. Then, an acceptability profile is established by sending a sample of acceptable products through the machine. Each time an acceptable homogeneous product is present, the address associated with that acceptable homogenous product is stored in memory, Steps 246 and 248. These steps are continued until all acceptable products in the sample pass through the system, Step 250. Then, the acceptability profile is established from the stored addresses by determining a range of acceptable addresses using any techniques well known to those of ordinary skill in the art. Then, each rejection signal is removed from each of the address in the address range associated with the acceptable products, Step 252.

Inquiry is then made to determine if a variable delay time and dwell time setting is desirable for identifiable, unacceptable non-homogeneous articles, Step 254. If not, the program returns to the sorting program shown in FIG. 9. If it is desirable to set the delay and dwell times to values different from the default values, then the system waits until a sample of unacceptable non-homogeneous articles passes through the system, Step 256. The addresses associated with the unacceptable non-homogeneous articles are stored until all articles in the sample pass through the system, Steps 256, 258, and 260. Then, the range of addresses associated with the unacceptable non-homogeneous articles is determined from the stored addresses in a manner similar to that used to define the acceptability profile, Step 262. Then, dwell and delay times corresponding to the unacceptable non-homogeneous articles are assigned to the address range. Steps 254–264 are repeated until the ejection profiles for all identifiable, unacceptable non-homogeneous articles have been established.

The software in the alternate preferred embodiment of this invention described above can be adapted by one of ordinary skill in the art to accommodate the reverse fire option described in the first preferred embodiment described above.

Figure 10:
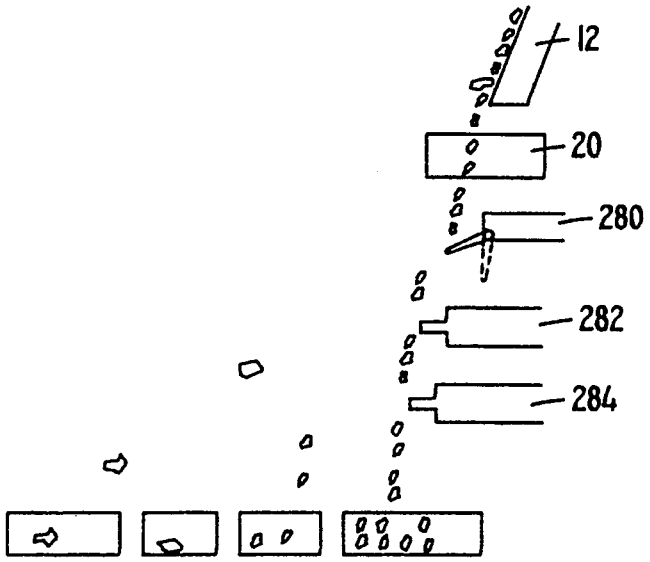
FIG. 10 is a side view of an ejector arrangement in an electro-optical sorting machine in accordance with an alternate preferred embodiment of this invention.

The software in both of the embodiments that have been described, can easily be adapted to a system utilizing more than one ejector, such as the one shown in FIG. 10. As shown, ejectors 280, 282, and 284 are each located a different distance, and thus, a different delay time away from viewing station 20. Instead of changing the delay time, a different ejector could be selected. The dwell times can be varied in the same or similar matter.

FIG. 4 and the software in both of the embodiments described above can also be modified to sort items based on the percentage reflectivity of a single wavelength. The resulting system is a monochromatic sorting machine.

The software in both embodiments that have been described, can also be implemented by one of ordinary skill in the art on a belt sorting machine, which can incorporate the use of both mechanical and pneumatic ejectors and wherein the dwell time would be adjusted for activating the ejector for ejecting a detected non-homogeneous article from the product and article stream. The software can also be adapted for use in conjunction with mechanical ejectors by one of ordinary skill in the art.

From the foregoing it will be seen that this invention is one well adapted to attain all of the ends and objects hereinabove set forth, together with other advantages which are obvious and which are inherent to the apparatus.

It will be understood that certain features and subcombinations are of utility and can be employed without reference to other features and subcombinations. This is contemplated by and is within the scope of the claims.

As many possible embodiments can be made of the invention without departing from the scope thereof, it is to be understood that all matter herein set forth or shown in the accompanying drawings is to be interpreted as illustrative and not in a limiting sense.

What is claimed is:

1. A sorting machine for sorting unacceptable articles from a stream of products and articles passing through the sorting machine, comprising an optical viewing station including means for reflecting light in first and second wavelengths off the products and articles passing through the viewing station, and light receiving means adapted to generate first and second electrical signals respectively representative of the intensity of light reflected in the first and second wavelengths from the products and articles passing through the viewing station, an article classifier responsive to the signals from said light receiving means for classifying the products and articles into respective classifications on the basis of the intensity of light reflected from the products and articles at the first and second wavelengths, an ejector for ejecting unacceptable articles from the stream of products and articles determined to require a long dwell ejector time in excess of a normal predetermined period representative of dwell time necessary to eject unacceptable product, and means for generating a long dwell ejector signal for activating said ejector for a dwell time in excess of the normal predetermined period when an unacceptable article from the stream of products and articles is aligned opposite said ejector by comparing the classification thereof to a predetermined acceptable classification map and determining that the classification of the unacceptable article is in a predetermined zone outside of the predetermined acceptable classification map.

2. A sorting machine in accordance with claim 1 wherein said means for generating said long dwell ejector signal is established to eject unacceptable non-homogeneous articles from the product and article stream, said means for generating said long dwell ejector signal including means for producing said long dwell ejector signal at a predetermined time delay period after the unacceptable non-homogeneous article passes through said optical viewing station.

3. A sorting machine in accordance with claim 2, and including a second ejector for ejecting unacceptable homogeneous products from the stream of products and articles determined to require a normal dwell ejector time corresponding to said predetermined period, and means for generating a normal dwell ejector signal for activating said second ejector when an unacceptable homogeneous product from the stream of products and articles is aligned opposite said second ejector by comparing the classification thereof to the predetermined acceptable classification map and determining that the classification of the unacceptable homogeneous product is outside of the predetermined acceptable classification map and not in the predetermined zone.

4. A sorting machine in accordance with claim 3, wherein said means for generating said normal dwell ejector signal is established to eject unacceptable homogeneous products from the product and article stream, said means for generating said normal dwell ejector signal including means for producing said normal dwell ejector signal at a second predetermined time delay period after the unacceptable homogeneous product passes through said optical viewing station.

5. A sorting machine in accordance with claim 1, wherein the period of said long dwell ejector signal is variably settable.

6. A sorting machine in accordance with claim 5, wherein the starting time of the period of said long dwell ejector signal is variably settable.

7. A sorting machine in accordance with claim 5, wherein the duration of the period of said long dwell ejector signal is variably settable.

8. A sorting machine in accordance with claim 1, wherein said predetermined zone outside of the predetermined acceptable classification map is established for ejecting light colored, light weight foreign articles.

9. A sorting machine in accordance with claim 1, wherein said predetermined zone outside of the predetermined acceptable classification map is established for ejecting dark colored, light weight foreign articles.

10. A sorting machine in accordance with claim 1, wherein said predetermined zone outside of the predetermined acceptable classification map is established for ejecting dark colored, heavy foreign articles.

11. A sorting machine in accordance with claim 1, wherein said predetermined zone outside of the predetermined acceptable classification map is established for ejecting light colored, heavy foreign articles.

12. A sorting machine for sorting unacceptable items from a stream of products and articles passing through the sorting machine, comprising an optical viewing station including means for reflecting light in first and second wavelengths off the products and articles passing through the viewing station, and light receiving means adapted to generate first and second electrical signals respectively representative of the intensity of light reflected in the first and second wavelengths from the products and articles passing through the viewing station, an article classifier responsive to the signals from said light receiving means for classifying the products and articles into respective classifications on the basis of the intensity of light reflected from the articles at the first and second wavelengths, an ejector for ejecting unacceptable homogeneous products from the stream of products and articles when unacceptable products are detected, an ejector for ejecting unacceptable non-homogeneous articles from the stream of products and articles located at a distance from said viewing station different from the ejector of unacceptable homogeneous products, and means for generating a signal at a time delay for activating said ejector of unacceptable non-homogeneous articles when an unacceptable non-homogeneous article from the stream of products and articles is aligned opposite said ejector by comparing the classification thereof to a predetermined acceptable classification map and determining that the classification of the article is in a predetermined zone outside of the predetermined acceptable classification map.

13. A sorting machine in accordance with claim 12, wherein said ejector for ejecting unacceptable non-homogeneous articles is located at a distance from said viewing station that is closer than the ejector of unacceptable homogeneous products.

14. A sorting machine in accordance with claim 12, where said ejector for ejecting unacceptable non-homogeneous articles is located at a distance from said viewing station that is further than the ejector of unacceptable homogeneous products.

15. A sorting machine in accordance with claim 12, where in said ejector for ejecting unacceptable non-homogeneous articles is mechanically operated.

16. In a sorting machine for sorting unacceptable items from a stream of products and articles passing through the sorting machine and producing an ejector signal for ejecting unacceptable items from the stream of products and articles at a time delay following unacceptable detection and for a dwell-time duration suitable for ejection removal dependent upon a classification category, including an optical viewing station including means for reflecting light in first and second wavelengths off the products and articles passing through the viewing station, and light receiving means adapted to generate first and second electrical signals respectively representative of the intensity of light reflected in the first and second wavelengths from the products and articles passing through the viewing station, and a plurality of ejectors at respectively different locations below said viewing station for ejecting unacceptable items from the product and article stream of respectively different classification categories, ejector control means, comprising an article classifier responsive to the signals from said light receiving means for classifying the products and articles into respective classifications on the basis of the intensity of light reflected from the products and articles at the first and second wavelengths, and means for generating an ejector signal at a time following unacceptable item detection and for a dwell duration period for respectively activating therewith a selected one of said plurality of ejectors by comparing the classification of the detected unacceptable item to a predetermined acceptable classification map and determining that the classification thereof is in a respective predetermined zone category outside of the predetermined acceptable classification map.

17. A sorting machine for sorting unacceptable items from a stream of products and articles passing through the sorting machine by gravity feed, comprising an optical viewing station including means for reflecting light in first and second color wavelengths off the products and articles passing through the viewing station, and light receiving means adapted to generate first and second electrical signals respectively representative of the intensity of light reflected in the first and second color wavelengths from the products and articles passing through the viewing station, an article classifier responsive to the signals from said light receiving means for classifying the products and articles into respective classifications on the basis of the intensity of light reflected from the products and articles at the first second wavelengths, an ejector for ejecting unacceptable items from the stream of products and articles responsive to a dwell ejector signal and a delay ejector signal, and means for generating the dwell ejector signal and the delay ejector signal respectively associated with a predetermined dwell time and a predetermined delay time for activating said ejector when an unacceptable item from the stream of products and articles is aligned opposite said ejector by comparing the classification thereof to a predetermined acceptable classification map and determining that the classification of the unacceptable item is in a predetermined zone, wherein the predetermined zone is associated with the predetermined dwell time and the predetermined delay time.

18. A sorting machine for sorting unacceptable items from a stream of products and articles passing through the sorting machine, comprising an optical viewing station including means for reflecting light in first and second wavelengths off the products and articles passing through the viewing stations, and light receiving means adapted to generate first and second electrical signals respectively representative of the intensity of light reflected in the first and second wavelengths from the products and articles passing through the viewing station, an article classifier responsive to the signals from said light receiving means for classifying the products and articles into respective classifications on the basis of the intensity of light reflected from the products and articles at the first and second wavelengths, means for identifying an unacceptable item from the stream of products and articles on the basis of the classification of the unacceptable item, an ejector for ejecting the unacceptable item from the stream of products and articles, means for selecting an ejector delay time depending on the classification of the unacceptable item, and means for activating the ejector at the selected delay time away from detection of the unacceptable item, when the unacceptable item is aligned opposite said ejector.

19. A sorting machine in accordance with claim 18, wherein said means for selecting an ejector delay time includes means for comparing the classification of the unacceptable item to a predetermined classification map and determining that the classification of the unacceptable item is in a predetermined zone, wherein the predetermined zone is associated with the predetermined delay time.

20. A sorting machine in accordance with claim 18, wherein said means for selecting an ejector delay time includes means for accessing a location corresponding to the classification in a memory means, wherein the ejector delay time is stored at the location.

21. A sorting machine for sorting unacceptable items from a stream of products and articles passing through the sorting machine, comprising an optical viewing station including means for reflecting light in first and second wavelengths off the products and articles passing through the viewing station, and light receiving means adapted to generate first and second electrical signals respectively representative of the intensity of light reflected in the first and second wavelengths from the products and articles passing through the viewing station, an article classifier responsive to the signals from said light receiving means for classifying the products and articles into respective classifications on the basis of the intensity of light reflected from the products and articles at the first and second wavelengths, means for identifying an unacceptable item from the stream of products and articles on the basis of the classification of the unacceptable item, an ejector for ejecting the unacceptable item from the stream of products and articles, means for selecting an ejector dwell time depending on the classification of the unacceptable item, and means for activating the ejector for the selected dwell time when the unacceptable item is aligned opposite said ejector.

22. A sorting machine in accordance with claim 21, wherein said means for selecting an ejector dwell time includes means for comparing the classification of the unacceptable item to a predetermined classification map and determining that the classification of the unacceptable item is in a predetermined zone, wherein the predetermined zone is associated with the predetermined dwell time.

23. A sorting machine in accordance with claim 21, wherein said means for selecting an ejector dwell time includes means for accessing a location corresponding to the classification in a memory means, wherein the ejector dwell time is stored at the location.

24. A sorting machine for sorting unacceptable items from a stream of products and articles passing through the sorting machine, comprising an optical viewing station including means for reflecting light in a wavelength off the products and articles passing through the viewing station, and light receiving means adapted to generate an electrical signal representative of the intensity of light reflected in the wavelength from the products and articles passing through the viewing station, an article classifier responsive to the signals from said light receiving means for classifying the products and articles into respective classifications on the basis of the intensity of light reflected from the products and articles at the wavelength, means for identifying an unacceptable item from the stream of products and articles on the basis of the classification of the unacceptable item, an ejector for ejecting the unacceptable item from the stream of products and articles, means for selecting an ejector delay time depending on the classification of the unacceptable item, and means for activating the ejector at the selected delay time away from detection of the unacceptable item, when the unacceptable item is aligned opposite said ejector.

25. A sorting machine in accordance with claim 24, wherein said means for selecting an ejector delay time includes means for comparing the classification of the unacceptable item to a predetermined classification map and determining that the classification of the unacceptable item is in a predetermined zone, wherein the predetermined zone is associated with the predetermined delay time.

26. A sorting machine in accordance with claim 24, wherein said means for selecting an ejector delay time includes means for accessing a location corresponding to the classification in a memory means, wherein the ejector delay time is stored at the location.

27. A sorting machine for sorting unacceptable items from a stream of products and articles passing through the sorting machine, comprising an optical viewing station including means for reflecting light in a wavelength off the products and articles passing through the viewing station, and light receiving means adapted to generate an electrical signal representative of the intensity of light reflected in the wavelength from the products and articles passing through the viewing station, an article classifier responsive to the signals from said light receiving means for classifying the products and articles into respective classifications on the basis of the intensity of light reflected from the products and articles at the wavelength, means for identifying an unacceptable item from the stram of products and articles on the basis of the classification of the unacceptable item, an ejector for ejecting the unacceptable item from the stream of products and articles, means for selecting an ejector dwell time depending on the classification of the unacceptable item, and means for activating the ejector for the selected dwell time when the unacceptable item is aligned opposite said ejector.

28. A sorting machine in accordance with claim 27, wherein said means for selecting an ejector dwell time includes means for comparing the classification of the unacceptable item to a predetermined classification map and determining that the classification of the unacceptable item is in a predetermined zone, wherein the predetermined zone is associated with the predetermined dwell time.

29. A sorting machine in accordance with claim 27, wherein said means for selecting an ejector dwell time includes means for accessing a location corresponding to the classification in a memory means, wherein the ejector dwell time is stored at the location.

30. A method for sorting unacceptable items from a stream of products and articles passing through the sorting machine having an optical viewing station including means for reflecting light in first and second wavelengths off the products and articles passing through the viewing station, light receiving means adapted to generate first and second electrical signals respectively representative of the intensity of light reflected in the first and second wavelengths from the products and articles, and an ejector for ejecting any unacceptable items from the stream of products and articles passing through the viewing station, comprising the steps of monitoring the electrical signals to determine the intensity of light reflected in the first and second wavelengths, classifying the products and articles into respective classifications on the basis of the intensity of light reflected from the products and articles at the first and second wavelengths, identifying an unacceptable item from the flow of products and articles on the basis of the classification of the unacceptable item, selecting an ejector delay time depending on the classification of the unacceptable item, and activating the ejector at the selected ejector delay time away from detection of the unacceptable item, when the unacceptable item is aligned opposite the ejector.

31. A method for sorting unacceptable items from a stream of products and articles passing through the sorting machine having an optical viewing station including means for reflecting light in a wavelength off the products and articles passing through the viewing station, light receiving means adapted to generate an electrical signal representative of the intensity of light reflected in the wavelength from the products and articles, and an ejector for ejecting any unacceptable items from the stream of products and articles passing through the viewing station, comprising the steps of monitoring the electrical signals to determine the intensity of light reflected in the wavelength, classifying the products and articles into respective classifications on the basis of the intensity of light reflected from the products and articles at the wavelength, identifying an unacceptable item from the flow of products and articles on the basis of the classification of the unacceptable item, selecting an ejector delay time depending on the classification of the unacceptable item, and activating the ejector at the selected delay time away from detection of the unacceptable item, when the unacceptable item is aligned opposite the ejector.

32. A method for sorting unacceptable items from a stream of products and articles passing through the sorting machine having an optical viewing station including means for reflecting light in first and second wavelengths off the products and articles passing through the viewing station, light receiving means adapted to generate first and second electrical signals respectively representative of the intensity of light reflected in the first and second wavelengths from the products and articles, and an ejector for ejecting any unacceptable items from the stream of products and articles passing through the viewing station, comprising the steps of monitoring the electrical signals to determine the intensity of light reflected in the first and second wavelengths, classifying the products and articles into respective classifications on the basis of the intensity of light reflected from the products and articles at the first and second wavelengths, identifying an unacceptable item from the flow of products and articles on the basis of the classification of the unacceptable item, selecting an ejector dwell time depending on the classification of the unacceptable item, and activating the ejector for the selected ejector dwell time when the unacceptable item is aligned opposite the ejector.

33. A method for sorting unacceptable items from a stream of products and articles passing through the sorting machine having an optical viewing station including means for reflecting light in a wavelength off the products and articles passing through the viewing station, light receiving means adapted to generate an electrical signal representative of the intensity of light reflected in the wavelength from the products and articles, and an ejector for ejecting any unacceptable items from the stream of products and articles passing through the viewing station, comprising the steps of monitoring the electrical signals to determine the intensity of light reflected in the wavelength, classifying the products and articles into respective classifications on the basis of the intensity of light reflected from the products and articles at the wavelength, identifying an unacceptable item from the flow of products and articles on the basis of the classification of the unacceptable item, selecting an ejector dwell time depending on the classification of the unacceptable item, and activating the ejector for the selected ejector dwell time when the unacceptable item is aligned opposite the ejector.

34. In an sorting machine for sorting unacceptable items from a stream of products and articles passing through the sorting machine having an optical viewing station including means for reflecting light in at least one wavelength off the products and articles passing through the viewing station, light receiving means adapted to generate an electrical signal representative of the intensity of light reflected in such one wavelength from the products and articles, means for classifying the products and articles into respective classifications on the basis of the intensity of light reflected from the products and articles at such one wavelength, and an ejector for ejecting any unacceptable items from the stream of products and articles passing through the viewing station, a variable ejector delay time selection mechanism comprising means for identifying an unacceptable item from the flow of products and articles on the basis of the classification of the unacceptable item, and means for selecting an ejector delay time depending on the classification of the unacceptable item.

35. In an sorting machine for sorting unacceptable items from a stream of products and articles passing through the sorting machine having an optical viewing station including means for reflecting light in at least one wavelength off the products and articles passing through the viewing station, light receiving means adapted to generate an electrical signal representative of the intensity of light reflected in such one wavelength from the products and articles, means for classifying the products and articles into respective classifications on the basis of the intensity of light reflected from the products and articles at such one wavelength, and an ejector for ejecting any unacceptable items from the stream of products and articles passing through the viewing station, a variable ejector dwell time selection mechanism comprising means for identifying an unacceptable item from the flow of products and articles on the basis of the classification of the unacceptable item, and means for selecting an ejector dwell time depending on the classification of the unacceptable item.

36. A sorting machine in accordance with claim 34, wherein the means for reflecting light in at least one wavelength off the products and articles passing through the viewing station reflects two wavelengths of light off the products and articles, and the means for classifying utilizes the two wavelengths to classify the products and articles into respective classifications.

37. A sorting machine in accordance with claim 35, wherein the means for reflecting light in at least one wavelength off the products and articles passing through the viewing station reflects two wavelengths of light off the products and articles, and the means for classifying utilizes the two wavelengths to classify the products and articles into respective classifications.

* * * * *